US009480289B1

(12) United States Patent
Quander

(10) Patent No.: US 9,480,289 B1
(45) Date of Patent: Nov. 1, 2016

(54) GARMENT WITH ELASTIC SEAMS

(71) Applicant: Raphael Quander, Gardena, CA (US)

(72) Inventor: Raphael Quander, Gardena, CA (US)

( * ) Notice: Subject to any disclaimer, the term of this patent is extended or adjusted under 35 U.S.C. 154(b) by 0 days.

(21) Appl. No.: 14/172,744

(22) Filed: Feb. 4, 2014

(51) Int. Cl.
*A41D 1/06* (2006.01)
*A41D 1/08* (2006.01)

(52) U.S. Cl.
CPC ..... *A41D 1/08* (2013.01)

(58) Field of Classification Search
CPC ..... A41D 1/08; A41D 2300/22; A41D 1/06
See application file for complete search history.

(56) References Cited

U.S. PATENT DOCUMENTS 2,500,084 A * 3/1950 Metzger ..... 2/97
4,488,314 A * 12/1984 Johnson ..... A41D 1/08 2/23
4,785,480 A * 11/1988 Polsky ..... A41D 1/06 2/227
5,539,926 A * 7/1996 Mantos ..... A41D 1/08 2/228
6,421,831 B1 * 7/2002 Korff ..... A41D 1/00 2/115
6,751,804 B1 * 6/2004 Warner ..... A41D 1/067 2/23
D527,170 S * 8/2006 Chionna ..... D2/742
7,496,973 B2 * 3/2009 Jewell ..... A41D 13/0581 2/227
D608,527 S * 1/2010 Chionna ..... D2/742
7,707,658 B2 * 5/2010 Culhane ..... A41D 1/067 2/227
8,347,412 B2 * 1/2013 Clement ..... A41D 1/08 2/22
2012/0131729 A1 * 5/2012 Hernandez ..... A41D 13/065 2/410
2013/0031698 A1 * 2/2013 Valles ..... A41F 9/00 2/221
2013/0174324 A1 * 7/2013 Israel ..... A41D 1/06 2/237

* cited by examiner

*Primary Examiner* — Anna Kinsaul
(74) *Attorney, Agent, or Firm* — Patent Law & Venture Group; Gene Scott

(57) ABSTRACT

A garment usable for extreme sports is made of a tough fabric that is not easily damaged in falls and high speed contact with surfaces such as roads and sidewalks. The garment has elastic seams placed at points where an athlete may flex muscles and bend body parts. The seams enable bending tensile forces to be distributed between several layers of strips that are secured within the seams and having different elastic properties such as elastic limit, elastic cycle duration, and restoration force so that together these strips are able to exhibit plural properties that one material is unable to achieve.

12 Claims, 2 Drawing Sheets

GARMENT WITH ELASTIC SEAMS

BACKGROUND

The industrial field of this disclosure relates to garments and methods of their operation and application. This disclosure is more particularly directed to a garments for sporting activities.

BRIEF DESCRIPTION OF DRAWINGS

Like reference symbols in the drawing figures indicate like elements.

DETAILED DESCRIPTION

Figure 1:
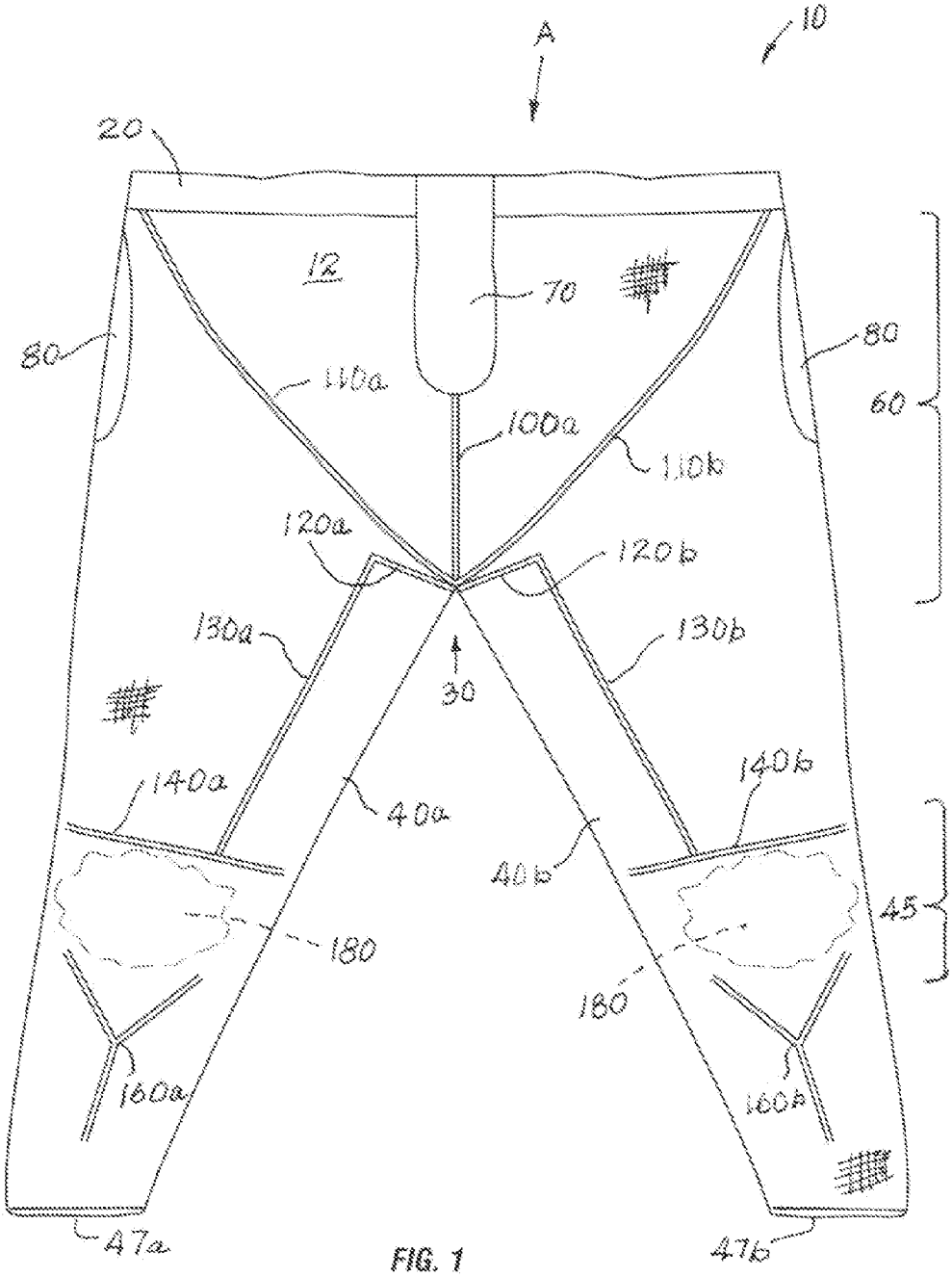
FIG. 1 is an example front elevation view of a garment according to the present disclosure.
Figure 2:
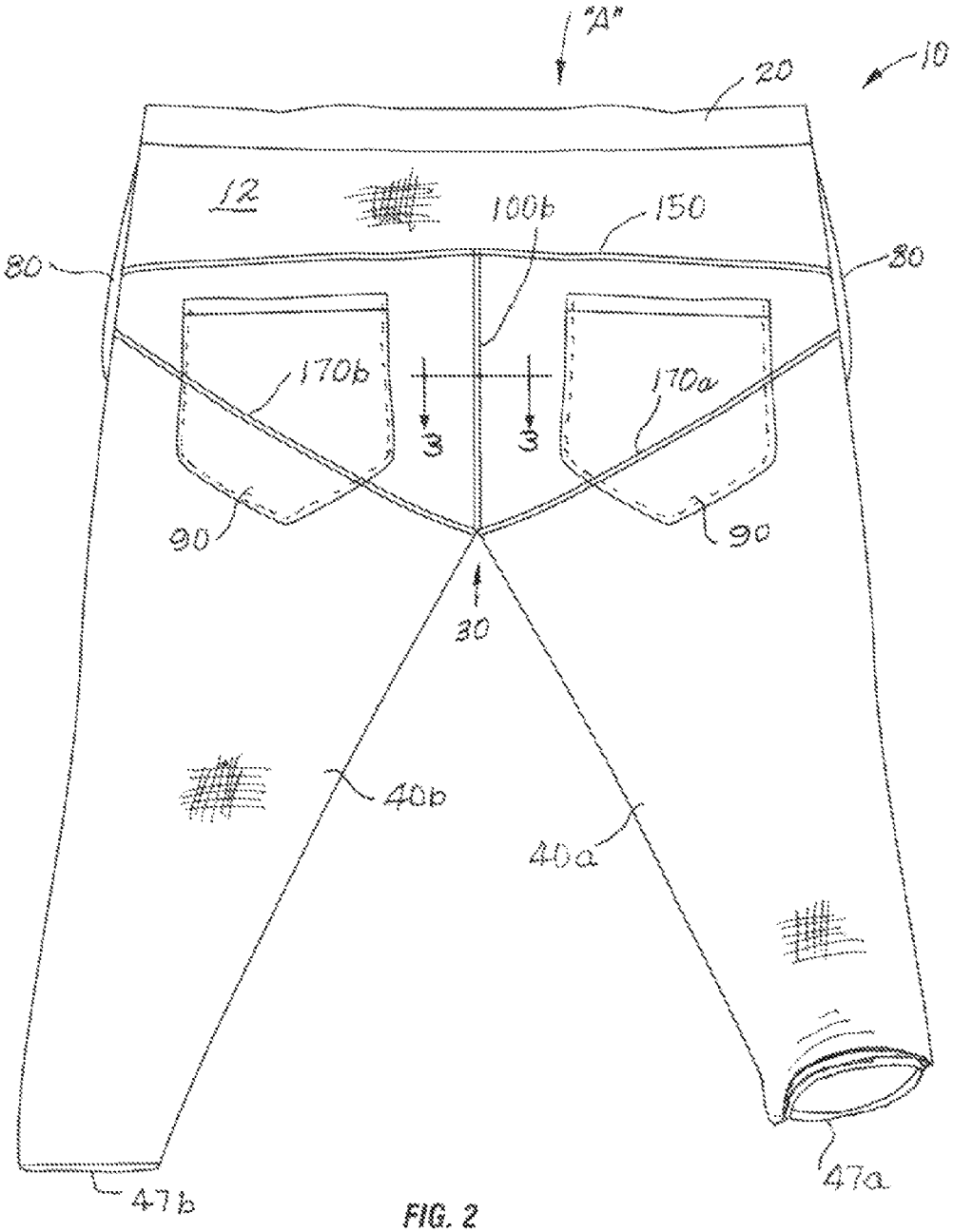
FIG. 2 is an example rear elevation view thereof.
Figure 3:
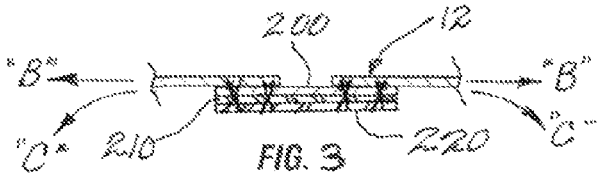
FIG. 3 is an example section taken at line 3-3 in FIG. 2.

The presently described apparatus is a garment exemplified by the pants 10 shown in FIGS. 1-3. The garment is designed to achieve the objective of providing an extreme toughness while also being able to accommodate the needs of an extreme sport such as known in skiing and skateboarding where body and legs are typically twisted and contorted into highly flexible positions where restraint by an outer garment must be voided. Pants 10 is made of a tough fabric 12 such as polyester, a blend of polyester and KEVLAR®, or other highly scuff and tear resistance material. However, beside the general fabric 12 of which pant 10 is made, pant 10 has elastic strips incorporated which form seams as will be described in detail. In normal use pants 10, is oriented as shown in FIGS. 1 and 2, and in this disclosure we refer to the top of pants 10, see arrow "A," which may have a waist band 20, and to the bottom of pants 10 at cuffs 47*a* and 47*b* which terminate pant legs 40*a* and 40*b*. Also, we refer to the front (FIG. 1), which includes portions of sides of pants 10 as a proximal aspect of the garment, and to the back or rear side (FIG. 2), which also includes portions of sides of pants 10 as a distal aspect of the garment. As shown in FIGS. 1 and 2 and as is well known in the art, waist band 20 may have loops (not shown) for engaging a belt or may have suspenders attached (not shown). Waist band 20 may define an open entry to pants 10 from the top direction. In an embodiment, pants 10 may have a fly 70. Pants 10 may have a crotch area 30 wherein legs 40*a* and 40*b* are joined to a trunk portion 60 which extends vertically from belt 20 to crotch area 30, and in embodiments may have one or two side pockets 80 and, or back pockets 90 as shown. In embodiments, legs 40*a* and 40*b* may be "long" as shown or may be "short" (not shown). Legs 40*a* and 40*b* as well as trunk portion 60 represent hollow aspects of the garment as is exemplified at reference numeral 47*a* in FIG. 2.

Referring now to FIG. 1 which shows a proximal aspect of pants 10, legs 40*a* and 40*b* are shown to be "long," and each may have a knee area 45 at the proximal face of the garment positioned medially between crotch area 30 and cuffs 47*a* and 47*b*. In an embodiment pads 180 may be sewn or otherwise attached on the inside of knee area 45 and may be fabricated of a shock absorbing material such as rubber or similar fabric or material. In an embodiment (not shown), pads 180 may have a complimentary additionally layer sewn or otherwise attached to the exterior of the leg fabric and such layer may be a tough, scuff resistant, material such as leather. Pants 10 as defined and described herein is distinguished from general and well-known pants garments as it has certain elastically expandable seams which are sewn into the fabric construction that makes up the garment and these seams are clearly shown in the figures. A proximal central seam 100*a* may extend from waist band 20 or from the fly 70 vertically downward into the crotch area 30. Long proximal diagonal seams 110*a* and 110*b* may extend from the crotch area 30 upwardly, diverging across the front of pants 10 to each side, terminating just above pockets 80 at waist band 20. A pair of short proximal diagonal seams 120*a* and 120*b* extend divergently upward from the crotch area 30 in positions below seams 110*a* and 110*b* respectively and terminate at leg seams 130*a* and 130*b* which extend downwardly on legs 40*a* and 40*b* respectively to upper knee seams 140*a* and 140*b*. Upper knee seams 140*a* and 140*b* may respectively extend in horizontal directions partially around the front of legs 40*a* and 40*b* in positions above pads 180. Y-shaped seams 160*a* and 160*b* are respectively positioned on legs 40*a* and 40*b* as shown, below pads 180 and centered on the proximal aspect of legs 40*a* and 40*b*.

Referring now to FIG. 2, which shows distal aspects of pants 10 including a distal trunk seam 150 which may extend horizontally around the distal aspect of pants 10 medially between band 20 and crotch 30 and may be positioned above pockets 90. A distal central seam 100*b* may extend from distal trunk seam 150 vertically and centrally downwardly to the crotch area 30 and may join, as a continuous single seam, with proximal central seam 100*a* fully splitting the crotch area 30. Distal diagonal seams 170*a* and 170*b* may extend from the crotch area 30 upwardly terminating near pockets 80 below trunk seam 150 and includes not only extension across pockets 90 but also parallel portions in the fabric 12.

It should be recognized that all of the seams defined above are approximately linear in the direction in which they travel on the garment. Seams 100*a* and 100*b* curve around the trunk and crotch areas against which they lie or extend and this curvature is in the direction of travel of these seams. Likewise seams 110*a* and 110*b*, seams 120*a* and 120*b*, seams 140*a* and 140*b*, seam 150, the V-portions of seams 160*a* and 160*b*, and seams 170*a* and 170*b* all curve in accordance with the garment's contour as it hubs the wearer's body, but such curvature is in the general direction of travel of each said seam. This is critically important to the successful achievement of pants 10 in meeting its objectives because all of said seams are able to expand elastically, that is, spread apart laterally and such spreading is attained without bunching. Bunching will, in fact, occur if said seams were to curve laterally from their general direction of travel on the garment and this will generally result in discomfort and resistance to body movements during extreme sport exercises.

Referring now to the section view of FIG. 3, it is shown that three layers 200, 210, and 220, make up the strips that form the above defined seams that are clearly shown in FIGS. 1 and 2. These three layers are elastically expansive fabrics which may be sewn in place as illustrated by the "X" marks in FIG. 3. However, joining may be accomplished as bonding, clipping, zipping or otherwise. Whatever form of attachment is used the three layers are securely fastened in place under cuts or splits in fabric 12 of pants 10 as described above, and, in fact, the layers when in place make up an integral part of the seams. The materials of which strips 200, 210, and 220 are fabricated are able to elastically extend under tensile forces and relax to their original shape when the forces are removed. This extension and relaxation process may occur over many cycles. As examples, pants 10 is forced to change shape during extreme sporting activities wherein the legs may be brought up to the chest in a jackknife position, (seams 110*a* and 110*b*, seams 120*a* and 120*b*, seams 170*a* and 170*b* and seam 150) are placed in tension, when a squatting position is assumed, (seams 130*a* and 130*b*, seams 140*a* and 140) are placed in tension, when the athletes legs assume the "split" position (seams 100*a* and 100*b*) are placed in tension, and when the athlete's trunk and legs are twisted into extreme positions various of the seams may be placed into tension in one degree or another. Tension may be applied to layers 200, 210, and 220 in different ways. For instance, as shown in FIG. 3, simple tensile force couples may be applied to the seams as shown by arrows "B." However, because of the curvature of the surface of the human body upon which the seams lie and changes in the contour of this surface as for instance when muscles are flexed, bending tensile force couples such as shown by arrows "C" are applied to layers 200, 210, and 220. In the first case, arrows "A," all three layers are stretched equally and the tensile forces are shared by the layers. In the second case, arrows "B," the elastic limit of layer 200 is greater than that of layer 210, and 210 is greater than in layer 220. It is known in the art that fabrics with a greater elastic limit also generally will sustain a greater number of operating cycles. However, a greater elastic limit in fabrics also means a relatively lower restoring force. Layer 210 has a higher restoring force and layer 220 a higher still restoring force. By combining layers 200, 210 and 220 the seams acquire an adequate strain while maintaining a significant restoring force over a generally acceptable number of cycle which may be in the range of 500 to 1,000. There is no one ideal fabric strip combination that meets the requirements for strain, cycle, and restorative force for all of the seams described herein. Each seam experiences a different tensile force degree of bending and repetition. Also, these variables differ from athlete to athlete depending on body conformation.

However, experience with extreme skateboarding sports has taught that we require a garment having seams that can experience more than 500 cycles with between 1.5 to 2 times elastic extension of the seam material and with a restoring force that will bring the seam back to 98% of its relaxed state within 25 milliseconds of withdrawal of its applied tensile force. Fabric combinations that can achieve this result may include: nylon spandex net, polymer sheeting, and tricot nylon cotton. Other fabrics and fabric combinations in various thicknesses may alternately be employed.

Embodiments of the subject apparatus and method have been described herein. Nevertheless, it will be understood that modifications by those of skill in the art may be made without departing from the spirit and understanding of this disclosure. Accordingly, other embodiments and approaches are within the scope of the following claims.

What is claimed is:

1. A garment having an expansion seam for enabling an extended range of motion of a body part of a person wearing the garment, the garment comprising:

a tough and durable garment fabric conforming to the human anatomy when the garment is donned, the garment fabric having plural seams extensive along separate near linear paths;

each of the seams constructed of plural material strips fastened in layers to the garment fabric said strips bridging spaced apart and separated splits in the garment fabric;

in each one of said seams, a first one of said layers fastened to the garment fabric;

a second one of said layers in contact with the first one of the layers and not in contact with the garment fabric;

a third one of said layers in contact with the second one of the layers and not in contact with the garment fabric;

the first one of said layers of a material having an elastic limit greater than an elastic limit of a material of the second one of said layers and the second one of said layers having an elastic limit greater than an elastic limit of a material of the third one of said layers;

the material of the first one of said layers having an ability to sustain a greater number of elastic cycle than the second one of said layers and the material of the second one of the layers having an ability to sustain a greater number of elastic cycles than the third one of the layers; and the material of the second one of said layers having a greater restoring force than the first one of said layers and the material of the third one of said layers having a greater restoring force than the second one of said layers.

2. The garment of claim 1 wherein one of the seams is a proximal central seam extending from a waistband to a crotch area of the garment.

3. The garment of claim 2 wherein a pair of proximal diagonal seams extend from the crotch area upwardly to sides of the garment.

4. The garment of claim 2 wherein a pair of proximal diagonal seams extend from the crotch area upwardly into contact with downwardly extending leg seams.

5. The garment of claim 2 wherein a pair of upper knee seams extend in horizontal directions partially around a front of legs of the garment.

6. The garment of claim 2 wherein a pair of Y-shaped seams are respectively positioned below knee pads on proximal aspect of legs of the garment.

7. The garment of claim 2 wherein a trunk seam extends horizontally around a distal aspect of the garment and is medially positioned between the waistband and the crotch of the garment.

8. The garment of claim 2 wherein a pair of distal diagonal seams extend from the crotch area upwardly to sides of the garment.

9. The garment of claim 1 wherein each of the plural strips of the seams is of a material selected from the group consisting of: nylon spandex net, polymer sheeting, and tricot nylon cotton.

10. The garment of claim 9 wherein at least one of the plural strips is able to experience more than 500 elastic cycles without noticeable degradation of the strip.

11. The garment of claim 9 at least one of the plural strips is able to experience between 1.5 to 2 times elastic extension while retaining a restoring force of at least 98% of an original restoring force after at least 500 elastic cycles of the strip.

12. The garment of claim 9 wherein at least one of the plural strips is able to resume a relaxed state within 25 milliseconds of withdrawal of a tensile force after at least 500 elastic cycles of the strip.

* * * * *